United States Patent [19]

Gènini et al.

[11] Patent Number: 4,570,716

[45] Date of Patent: Feb. 18, 1986

[54] SYSTEM AND APPARATUS OF LIASON BETWEEN AN UNDERWATER WELLHEAD AND A SURFACE SUPPORT

[75] Inventors: Maurice Gènini, Creteil; René Szabo, Le Pecq, both of France

[73] Assignee: Coflexip, Paris, France

[21] Appl. No.: 566,398

[22] Filed: Dec. 28, 1983

[30] Foreign Application Priority Data

Dec. 28, 1982 [FR] France ..... 82 21907

[51] Int. Cl.[4] ..... E21B 43/01

[52] U.S. Cl. ..... 166/346; 166/355; 166/360; 405/169

[58] Field of Search ..... 166/344, 346, 355, 360; 405/169, 195

[56] References Cited

U.S. PATENT DOCUMENTS

| | | | |
|---|---|---|---|
| 3,219,119 | 11/1965 | Matthews, Jr. | 166/346 |
| 3,378,066 | 4/1968 | Otteman et al. | 166/346 |
| 4,153,112 | 5/1979 | Luke | 166/355 |
| 4,342,519 | 8/1982 | Botrel et al. | 405/169 |
| 4,388,022 | 6/1983 | Gentry et al. | 405/195 |

*Primary Examiner*—Stephen J. Novosad
*Assistant Examiner*—William P. Neuder
*Attorney, Agent, or Firm*—Brisebois & Kruger

[57] ABSTRACT

A system of liason between an underwater wellhead for the production of hydrocarbons from underwater formations to a surface support. The system includes at least one flexible conduit (4) connected between the wellhead (2) and the surface support (1). Each flexible conduit is equipped at its lower end with means to limit the radius of bending or deflection and is connected vertically to the wellhead. Each conduit can be pulled or led into at least a first configuration (4*a*, 4'*a*, 4''*a*) in which the conduit is generally relaxed and non-tensioned, for the flow of hydrocarbons to the surface support, and at least a second configuration (4*b*), in which the conduit is at least partly tensioned, and sufficiently straight and upright that tools can be lowered to descend by gravity from the support surface to the well, for working of the well.

3 Claims, 5 Drawing Figures

8
4
10
11

4
8
10
11

SYSTEM AND APPARATUS OF LIASON BETWEEN AN UNDERWATER WELLHEAD AND A SURFACE SUPPORT

This invention relates to a system and apparatus of connection or liason between an underwater wellhead for the production of hydrocarbons extracted from an underwater formation, and a surface support such as a ship or a platform. The invention also relates to a method and system for flowing oil from the well to the surface support, and which also facilitates working or treating the well using the customary and conventional well tools.

BACKGROUND OF THE INVENTION

It is known to use one or more flexible conduits to collect and flow hydrocarbon products from an underwater wellhead to a surface support. Such conduits can be completely or partially tensioned, or not tensioned. The surface support can be a floating buoy, a ship, or a platform which is floating or fixed to the bottom of the body of water.

When it is necessary to carry out working of the submarine well, one connects between a surface support which can be the same as the surface support to which the flow conduits are connected, a vertical line through which the tools used to work the well can descend or can be lowered by gravity.

This makes the working procedures time consuming and complicated, and requires, in addition, at least one supplemental conduit or flow line.

SUMMARY OF THE INVENTION

The purpose of the present invention is a system and apparatus comprising at least one flexible conduit connected between a wellhead and a support surface, which provides for the different operations such as production and raising of hydrocarbon products, the lowering of tools to the well, and the lowering of the wellhead itself, if necessary.

The system and apparatus according to the invention is characterized by the fact that it comprises at least one flexible conduit connected between the wellhead and the surface support, the conduit or conduits being provided at their lower ends with means to limit the radius of bending or deflection of the lower ends, these lower ends being connected vertically to the well head. Each flexible conduit is capable of being pulled or led into at least a first configuration or profile in which the conduit is not tensioned, for upward flow of hydrocarbons, and at least a second configuration or profile in which the conduit is at least partly tensioned or taut, and in which tools can be lowered by gravity from the support surface to the well.

The support surface has at least two locations or stations for connection of each flexible conduit. There is a first location at the lower portion of the surface support which corresponds to the first or non-tensioned configuration of the conduit for collection of the hydrocarbons, and the second location, which is higher up on the surface support corresponds to a station equipped with means to lower tools through the conduit when the conduit is at least partly tensioned and brought to the second configuration.

Preferably, the flexible conduit (or conduits) in the second configuration extends at an angle to the vertical which is generally between 0° and 30°, and compatible with that necessary for the descent or lowering by gravity of the tools which are used for working or other operations in the well, this angle naturally being a function of the depth of water.

In the first configuration, corresponding to the collection or flowing of the hydrocarbons to the surface support, the conduit or conduits are suspended like chains, and assume the curve known as a catenary, with its configuration varying as a function of the position of the surface support relative to the wellhead, taking into consideration in particular, the movements and displacements resulting from swells, waves, and currents.

The means to limit the radius of deflection or bending of the flexible conduits adjacent their lower ends advantageously comprises a succession of hinged or jointed rings, themselves known in the art, and which form a non-rigid, flexible hinged or jointed vertebra.

In a first embodiment of the invention, the means to limit the radius of deflection or bending is connected to a curvature limitor fixed to the bottom tip or connecting ferrule of the flexible conduit and made of a plastic material with a high modulus of elasticity and whose section decreases progressively in an upward direction (i.e. tapers), from the connecting tip to the location of the means to limit the radius of deflection.

Such a limitor of curvature is described in French Application No. 79.01363 of Applicant's Assignee.

In a second embodiment of the invention there is provided instead of the curvature limitor mentioned above, a funnel shaped or trumpet shaped element, mounted vertically on the wellhead and which diverges upwardly, and in which the lower end of the flexible conduit which has the means to limit the radius of deflection is engaged for connection to the wellhead.

In a third embodiment of the invention, there is provided in addition to the means to limit deflection, both a curvature limitor in the conduit, and a trumpet or funnel shaped element on the wellhead.

In the first configuration of the conduit, corresponding to collection and upward flow of hydrocarbons, the flexible conduit or conduits fixed to the floating support are suspended in the form of chains with a configuration adjacent the vertical connection to the wellhead, which is like the neck of a swan. The apparatus which limits the radius of deflection and the curvature limitor or the element in the form of a funnel or trumpet is positioned to limit the deflection or curvature to a definite value to ensure correct retention of the dynamic position, the conduits then being able, as mentioned above, to follow or compensate for the movements of the surface support.

Other advantages and characteristics of the invention will become apparent from the following description of non-limiting embodiments, and with reference to the accompanying drawings.

DETAILED DESCRIPTION

Figure 1:
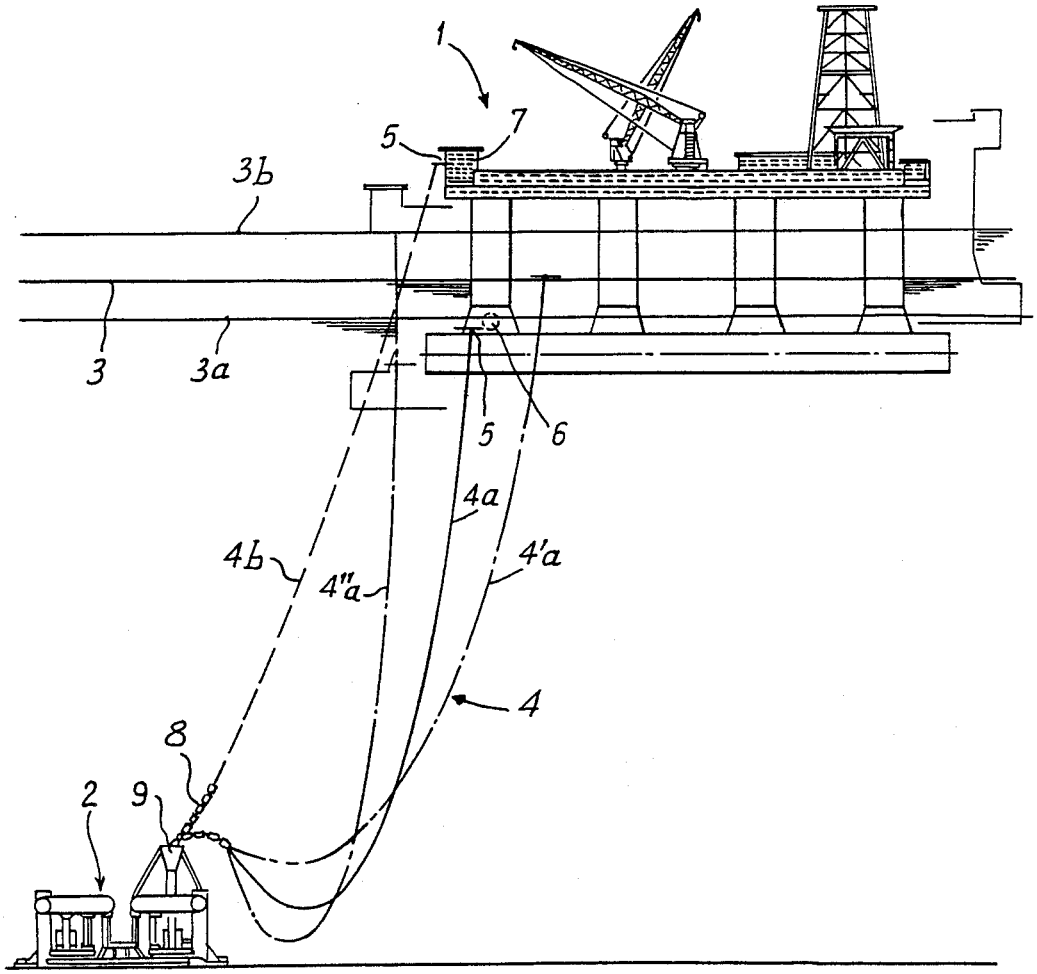
FIG. 1 shows a system and apparatus according to a first embodiment of the invention, and shows several operating configurations of a flexible conduit extending between the surface support and an underwater wellhead.

Referring now to FIG. 1, there is shown a conventional floating platform 1 for the exploitation of petroleum to which the hydrocarbons are, in the example shown, brought to the surface from a wellhead 2, through one or more flexible conduits 4 (only one being shown at FIG. 1).

FIG. 1 shows the different extreme positions of platform 1 corresponding to displacements whose vertical and horizontal amplitudes are caused by swells, waves, wind and currents. FIG. 1 shows the mean position of the platform corresponding to a level 3 of the ocean or water surface. The vertical extremes correspond respectively, to the levels 3*a* and 3*b*. The distance between the levels 3*a* and 3*b* can, for example, be 18 meters, and correspond to swell and wave heights in certain seas and waters.

The horizontal displacements between the extreme positions of the platform can be, for example, plus or minus 15 meters from a mean position.

FIG. 1 shows a flexible conduit 4 of great length, and of the type marketed by Applicant's Assignee. The conduit 4 can, for example, have a diameter of 4 inches (10.16 cm). While only a single conduit is shown, there can, of course, be additional conduits connected between the well 2 and the platform 1, and such additional conduits can include umbilical conduits for remote control, and signal transmission.

As shown at FIG. 1, the conduit 4 can take a first position or configuration in which the conduit is not tensioned, as shown at 4*a*, 4'*a*, and 4''*a*, depending on the different permissable positions of the platform, and a second position 4*b* in which the conduit is taut or tensioned, and forms an angle of 30° with respect to the vertical.

In the first configuration or condition 4*a*, and the respective conditions 4'*a* and 4''*a*, the conduit is connected by its upper end 5 to a treatment station, specifically, a degasser 6 situated near a lower portion of the platform.

The configuration shown on the drawing corresponds to an installation where the platform is generally vertically above the well. One can naturally envision, according to the invention, that the platform is elongated, in which case the conduit is not tensioned, being relaxed, and the conduit 4 comes out of the wellhead and extends to the submarine floor, and then upwardly toward the platform, in a non-tensioned profile.

In the second or tensioned profile 4*b*, the upper end 5 of the conduit is brought to a station 7 in the vicinity of an upper portion of the platform. The station 7 is a station from which tools for working the well can be introduced into the conduit and can be lowered or descend by gravity through the conduit to the well, when the conduit is in the tensioned or taut configuration 4*b*. Sections of rigid or flexible conduit can be added if necessary to the upper portion of the conduit 4, of the configurations 4*a*, 4'*a*, or 4''*a* to permit connection to station 7 and to attain the configuration 4*b*.

Figures 4, 5:
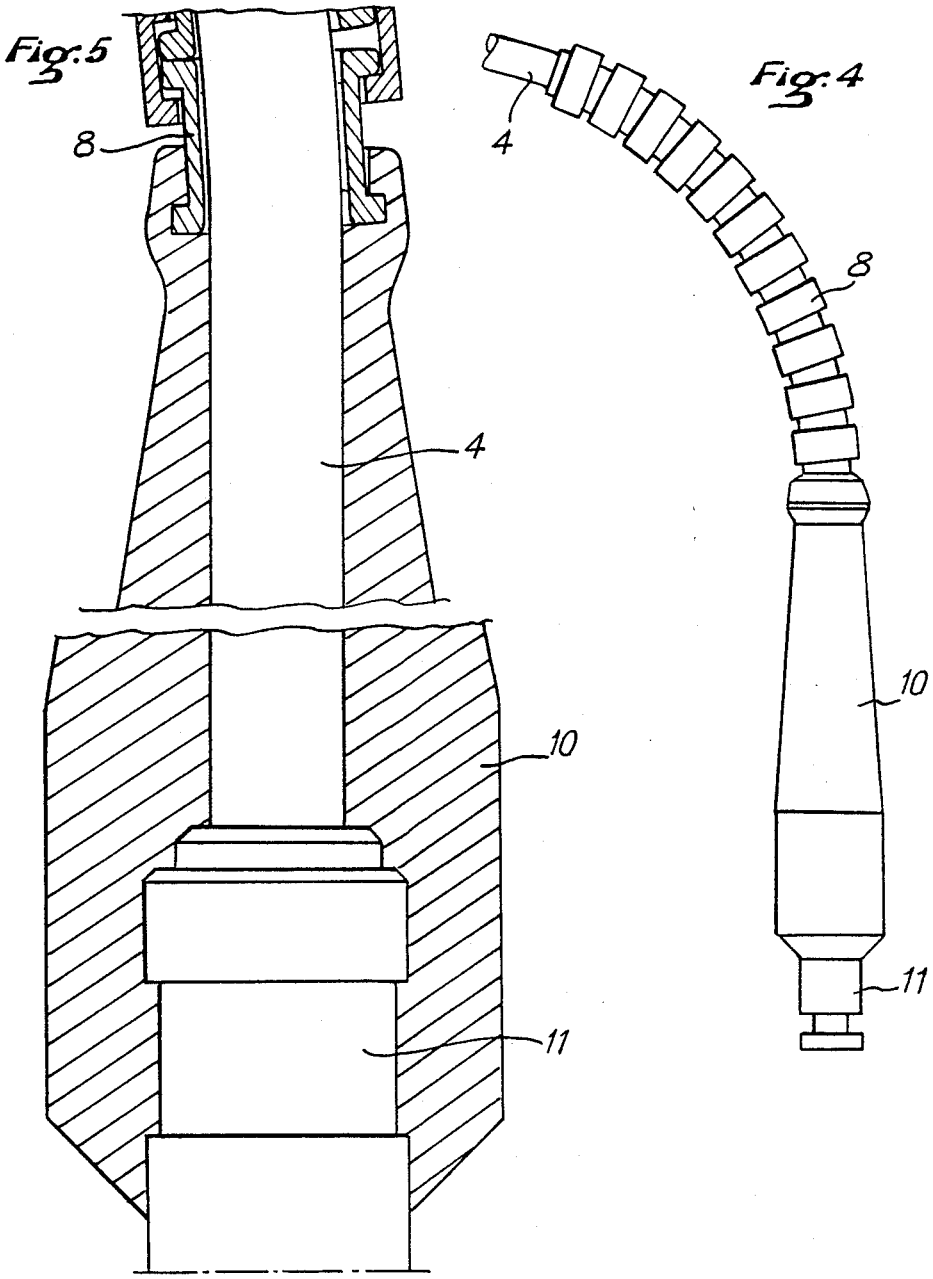
FIG. 4 shows the lower end of a conduit of the embodiments of FIGS. 2 and 3.
FIG. 5 is an enlarged broken view in section of the lower end of the conduit of FIG. 4.

At its lower end the conduit has, as shown at FIGS. 4 and 5, an assembly of hinged rings or annular articulations 8 disposed in succession and which assure limiting the radius of bending or deflection of the conduit.

In the embodiment of FIG. 1 there is provided at the wellhead, a vertically upwardly extending element in the shape of a funnel or trumpet 9 into which the lower end of the conduit engages. Inside the trumpet is a connector for making a vertical connection between the lower end of the conduit and the wellhead.

Because of the annular articulations 8 and the trumpet shaped element 9, the conduit 4 in its configuration 4*a* presents a profile having the form of the neck of a swan, from the wellhead, and then a section having the classic curve of a chain, and which can, if necessary, between the two sections, have a portion reposing on the bottom when the platform is not plumb or vertically above the wellhead. The portion of the conduit between the outer end of articulations 8 and upper end 5 has a catenary curve.

This configuration 4*a* corresponds to configuration of the conduit for the recovery of, or flow of, the hydrocarbons to the platform. In contrast, the tensioned configuration or substantially tensioned configuration 4*b* is as previously mentioned, to permit the introduction and descent by gravity of tools into the well. When necessary, to attain this configuration, when the platform is not plumb or vertically above the well, one can use a vessel to bring back the upper end of the conduit essentially to a position in the vicinity of the vertical to the wellhead to permit attaining the tensioned configuration or profile 4*b*.

The embodiment of FIGS. 2 through 5 differs from that of FIG. 1 essentially by the fact that the element 9 in the form of a trumpet is not provided at the wellhead 2. The conduit below the annular articulations 8 has a curvature limitor 10 extending to a connecting ferrule or tip 11 of the conduit to assure its vertical connection to the wellhead, this curvature limitor being of a type described in French Application No. 79.01369.

Referring to FIG. 1, it can be seen that the conduit 4, in its positions 4*a*, 4'*a*, and 4''*a* is sufficiently slack that it can readily compensate for movements of the platform both vertically and horizontally without producing undue stresses in the conduit, within the previously defined limits of movement of the platform. In this generally slack position of the conduit, the bending or deflection limiting means 8 engages the interior of the trumpet shaped element 9 so that the trumpet shaped element 9 further limits the extent of permissable deflection or bending of the portion of section 9 which is within the trumpet 9. Such an arrangement tends to prevent permanent deformation of the deflection limiting means 8 in the event of a hard horizontal pull on the conduit. By virtue of the deflection limiting means, it is assured that no kinking or sharp bends will form in the region of the conduit adjacent the wellhead, which in turn assures that well tools which are lowered through the conduit from station 7, with the conduit in the configuration 4*b*, will be able to traverse the entire length of the conduit and pass into the wellhead.

Figure 2:
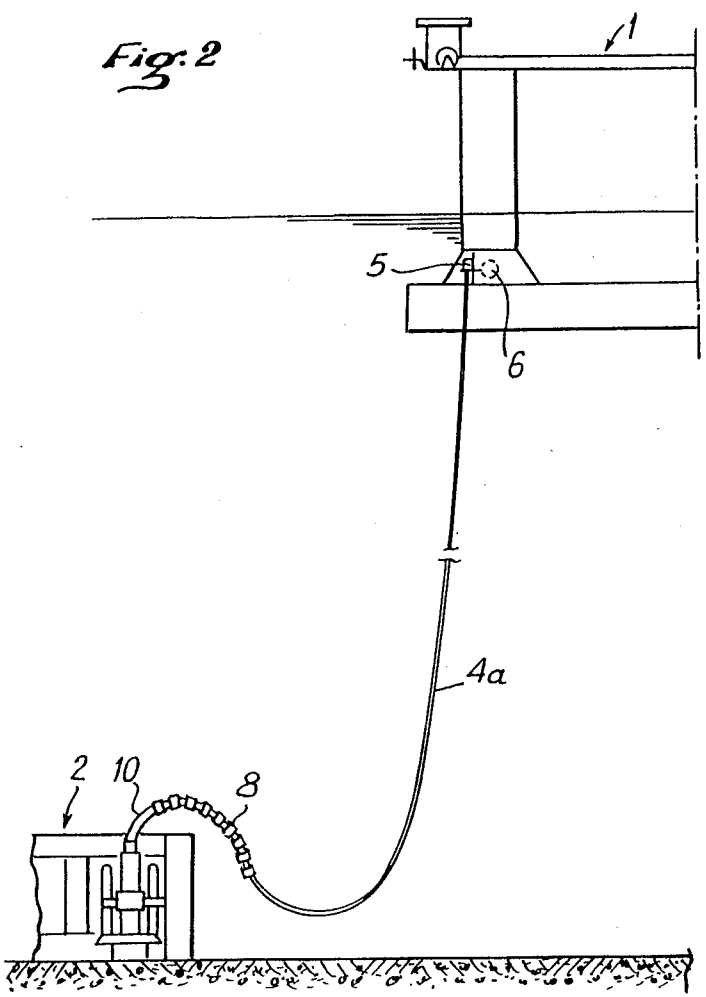
FIG. 2 shows a second embodiment with the flexible conduit in a first configuration in which the conduit is not tensioned.

In the embodiment of FIGS. 2–5, the curvature limitor 10 is provided between the deflection limiting means 8 and the connector at the bottom of the conduit, which is vertically connected to the wellhead. When the conduit is in its slack condition 4*a*, as shown at FIG. 2, the curvature limitor 10 elastically bends to the configuration shown at FIG. 2 and avoids any permanent short radius bending in the region of the lower end of the conduit adjacent the wellhead. The deflection limiting means 8 generally forms a continuation of the deflection limitor 10 as is evident from FIG. 2.

Figure 3:
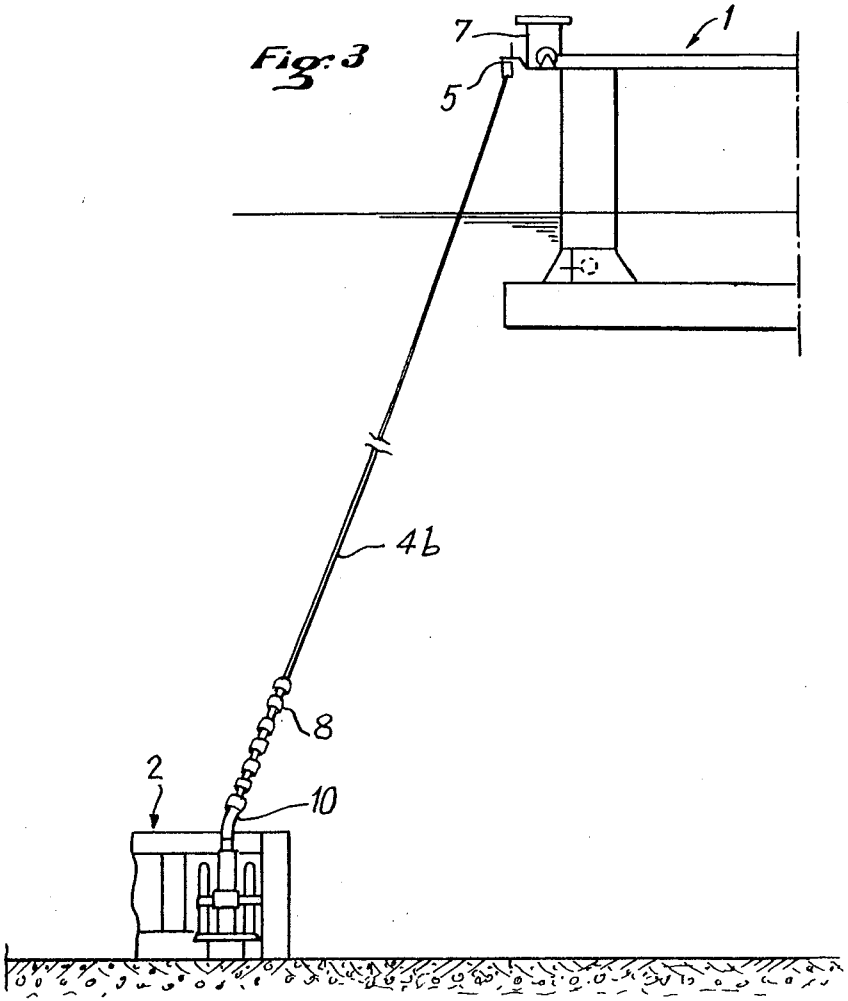
FIG. 3 shows the second embodiment with the conduit tensioned for lowering well tools through the conduit by gravity.

When it is desired to treat the well, or lower tools into the well, the upper end 5 of the conduit is disconnected from the lower portion of the platform and is reconnected to the platform adjacent station 7. This station 7 can include the needed apparatus for pulling the conduit to the second or tensioned configuration 4*b* as shown at FIG. 3, in which the conduit is generally straight, to permit well working tools to be lowered through the conduit into the wellhead. For lowering tools by gravity through the conduit, it is preferred that the angle between the conduit 4*b* and the vertical, not be greater than about 30°, which assures relatively free downward movement of the tools into the wellhead by gravity.

The station 7 from which tools are lowered from the platform 1, through the conduit 4*b* to the wellhead, can include suitable constant tension devices, such as a winch, to maintain constant tension in the conduit despite movements of the platform within certain limits, as previously explained.

As previously indicated, curvature limitor 10 has its lower end connected to a connecting tip 11 at the bottom of conduit 4, as shown at FIG. 4. Deflection limitor 10 can be fixed to tip 11 by bonding or molding the plastic material of curvature limitor 10 around the lower end of the conduit and its tip, as generally shown at FIG. 5.

Connected to the upper end of the curvature limitor 10 is portion of the conduit having the means to limit deflection or bending 8, in the form of articulated annular rings, and the lower end of which is shown at FIG. 5.

It is to be appreciated that the conduit shown at FIG. 4 with the curvature limitor 10 of plastic material adjacent its lower end, can be used to connect the conduit to the wellhead of FIG. 1. When the curvature limitor 10 is used in combination with the funnel or trumpet 9 of the wellhead, the element 9 functions to limit the extent of bending of the curvature limitor portion 10 of the conduit. This tends to reduce stresses in and the formation of a permanent set in the curvature limitor 10 even after substantial horizontal forces are exerted on the conduit.

It is believed evident that the means to limit deflection 8, particularly when combined with the curvature limitor 10 or the trumpet element 9, functions to assure that no kinks or constrictions are formed in the conduit 4 which could restrict passage of the tools customarily used for working the well. Correspondingly, by virtue of Applicant's arrangement, it is assured that the conduit can be used for lowering tools by gravity to work the well even after considerable use for flowing the hydrocarbon products from the well to the floating platform.

It is further to be appreciated that the conduit 4 can be used in the customary manner to assist lowering the wellhead to the bottom of the body of water. This permits connecting the conduit to the wellhead at the surface so the need for making a connection underwater is avoided.

While the invention has been described in connection with several embodiments, it is evident that it is not thereby limited, and that numerous variations and modifications can be made without departing from the scope and spirit of the invention.

We claim:

1. A method of flowing hydrocarbons through a flexible conduit from an underwater well to a surface support, and for lowering well working tools into the well through the same flexible conduit, said method comprising connecting a lower connector end of a flexible conduit downwardly into an upwardly opening underwater connector of the well, connecting an upper end of the flexible conduit to a hydrocarbon receiving station of the surface support, flowing hydrocarbons through the flexible conduit while permitting the flexible conduit to assume a goose neck and catenary configuration to compensate for the effects of waves and water levels, limiting the radius of deflection of the flexible conduit adjacent said lower connector end with a deflection limitor, disconnecting the upper end of the conduit from the hydrocarbon receiving station on the surface support, then connecting the flexible conduit to the surface support at a work station with the conduit tensioned and sufficiently straight between its upper and lower ends to move tools into the well, and lowering a tool into the well through the flexible conduit.

2. The method according to claim 1 wherein the step of connecting the flexible conduit to a work station comprises connecting the flexible conduit to a work station on the surface support at an elevation significantly higher than the hydrocarbon receiving station.

3. The method according to claim 1 further comprising maintaining the flexible conduit between 0° and 30° to vertical, while lowering a tool through the conduit.

* * * * *